United States Patent [19]

Wade et al.

[11] 4,100,886

[45] Jul. 18, 1978

[54] AUTOMATIC HEADGATE FOR ANIMALS

[76] Inventors: Jerry D. Wade, Rte. 2, Box 76; Phillip H. Geisler, Rte. 1, Box 40, both of Galena, Kans. 66739

[21] Appl. No.: 718,037

[22] Filed: Aug. 26, 1976

[51] Int. Cl.[2] ..... A61D 3/00

[52] U.S. Cl. ..... 119/98

[58] Field of Search ..... 119/98, 99, 103, 147, 119/149, 150

[56] References Cited

U.S. PATENT DOCUMENTS

| | | | |
|---|---|---|---|
| 3,010,429 | 11/1961 | Grissom | 119/98 |
| 3,043,269 | 7/1962 | Kausche | 119/99 |
| 3,221,707 | 12/1965 | Pearson | 119/98 |
| 3,511,216 | 5/1970 | George | 119/147 |
| 3,538,890 | 11/1970 | Torell | 119/98 |

*Primary Examiner*—Russell R. Kinsey
*Assistant Examiner*—Robert P. Swiatek
*Attorney, Agent, or Firm*—Clarence A. O'Brien; Harvey B. Jacobson

[57] ABSTRACT

An automatic headgate for animals has a rigid, vertically standing frame provided with an opening permitting an animal to pass through the frame. A gate assembly forming a traffic funnel for guiding animals into position for retention by the headgate is mounted on the frame for selective movement between an open position and a closed position in which the gate assembly forms a stanchion restraining an animal from movement. Connected to the gate assembly is a force-applying arrangement disposed for biasing the gate assembly toward its closed position, while a trigger mechanism is connected to the gate assembly for releasably retaining the gate assembly in its open position and releasing the gate assembly to its closed position when pressure lateral of the vertical is applied to the gate assembly from within the opening of the frame as by an animal attempting to pass through the headgate.

16 Claims, 11 Drawing Figures

AUTOMATIC HEADGATE FOR ANIMALS

BACKGROUND OF THE INVENTION

1. Field of the Invention

This invention relates generally to restraining devices, and particularly to an automatic headgate constructed especially for catching and detaining steer and similar animals for inoculation and like purposes.

2. Description of the Prior Art

It is generally known to provide headgates for the purpose of restraining, or trapping, an animmal as at the head of a chute, an entrance to a corral, or other animal enclosure in order to facilitate the giving of inoculations to the animal, treating wounds sustained by the animal, and like operations commonly arising when dealing with livestock, U.S. Pat. Nos. 1,135,004, issued Apr. 13, 1915, to J. H. Flatley, and 2,566,013, issued Aug. 28, 1951, to R. E. Abernathy, disclose examples of such headgates primarily intended for hogs and provided with structure for securing the head of the animal in place by means of doors or gates pivotally supported and locked in position by a ratchet and pawl arrangement. Further, U.S. Pat. No. 2,801,612, issued Aug. 6, 1957, to P. H. McMurray et al., discloses a pivotal door arrangement as part of a headgate in which a friction lock is provided for securing the doors in pivoted, or open, position, while U.S. Pat. No. 3,043,269, issued July 10, 1962, to M. K. Kausche discloses an automatic stanchion in which the gates both pivot and slide and are mechanically interconnected for simultaneous movement with ratchet and pawl locks for securing the gates in a desired adjusted position. In addition, U.S. Pat. No. 3,538,890, issued Nov. 10, 1970, to C. R. Torell discloses an animal headgate having pivotal gates which are pivoted toward a parallel relation by forward movement of the animal with a latch device retaining the pivotal gates in animal retaining position, with U.S. Pat. No. 3,788,280, issued Jan. 29, 1974, to C. Van Gilst disclosing a friction latch device for animal gates for retaining the gates in an animal retaining position.

SUMMARY OF THE INVENTION

It is an object of the present invention to provide an animal headgate of quicker acting and more reliable construction than known headgates.

It is another object of the present invention to provide an animal headgate which offers the options of automatic catch, semi-automatic catch, and manual catch of an animal.

It is still another object of the present invention to provide an animal headgate which offers a quick release in the event tha the animal goes down or for any other occasion where a quick and safe release is required.

It is yet another object of the present invention to provide an animal headgate which requires only a small amount of lateral pressure exerted by an animal on the gate in order to close the gate. This object permits small calves as well as large animals to trip the gate, and also eliminates bruising of the shoulders of the animal.

It is a still further object of the present invention to provide an animal headgate which is easily adjustable for all size animals, permitting one to catch a cow and immediately follow up with a small calf, and the like.

It is an object of the present invention to provide an animal headgate affording full walk-through design for all size animals.

It is yet an additional object of the present invention to provide an animal headgate wherein the stanchion is locked in both its open and closed positions by separate locks assuring a positive lock for the lateral motion of the gates, with either lock being able to hold the gates closed in case of the failure of one of the locks. Both locks can be released simultaneously when the animal is to be released.

It is yet another object of the present invention to provide an animal headgate which uses a wider opening than commonly encountered with prior art headgates and offers the animal less resistance to putting the head of the animal into the frame of the headgate, while the gates in their open position to receive the animal, create a funneling entranceway which further helps to alleviate the problem of resistance of the animal to entering the headgate.

These and other objects are achieved according to the present invention by providing an automatic headgate for animals which has: a rigid, vertically standing frame providing with an opening of sufficient size to permit animals of various sizes to pass through; a gate assembly mounted on the frame for selective movement between an open position forming a traffic funnel for guiding animals into position within the frame and permitting an animal to pass through the opening provided in the frame, and a closed position in which the gate assembly forms a stanchion restraining an animal from movement; a force-applying arrangement connected to the gate assembly for biasing the gate assembly toward its closed position; and a trigger mechanism connected to the gate assembly for releasably retaining the gate assembly in its open position and releasing the gate assembly to its closed position when pressure lateral of the vertical frame is applied to the gate assembly.

An advantageous feature of the present invention is that the trigger mechanism is provided with a lock arrangement including a pair of lock devices for releasably holding articulated panels of the gate assembly in place between and including the open position and the closed position of the gate assembly. While one of the lock devices is primarily intended to hold the gate assembly open and the other of the lock devices to hold the gate assembly closed, the preferred arrangement of the lock devices will permit either of the devices to hold the gate assembly both open or closed in the event one of the lock devices should fail for any reason.

These together with other objects and advantages which will become subsequently apparent reside in the details of construction and operation as more fully hereinafter described and claimed, reference being had to the accompanying drawings forming a part hereof, wherein like numerals refer to like parts throughout.

DESCRIPTION OF THE PREFERRED EMBODIMENTS

Figure 1:
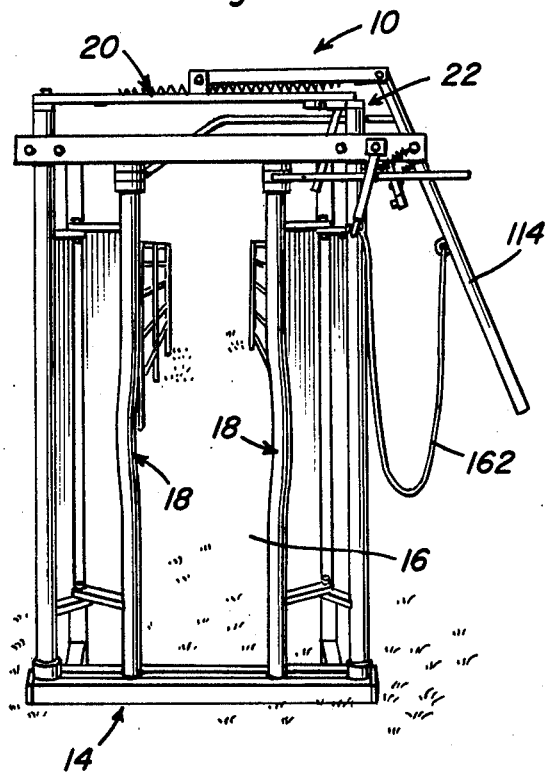
FIG. 1 is a front perspective view showing an animal headgate according to the present invention disposed in an open position at the head of a chute.
Figure 2:
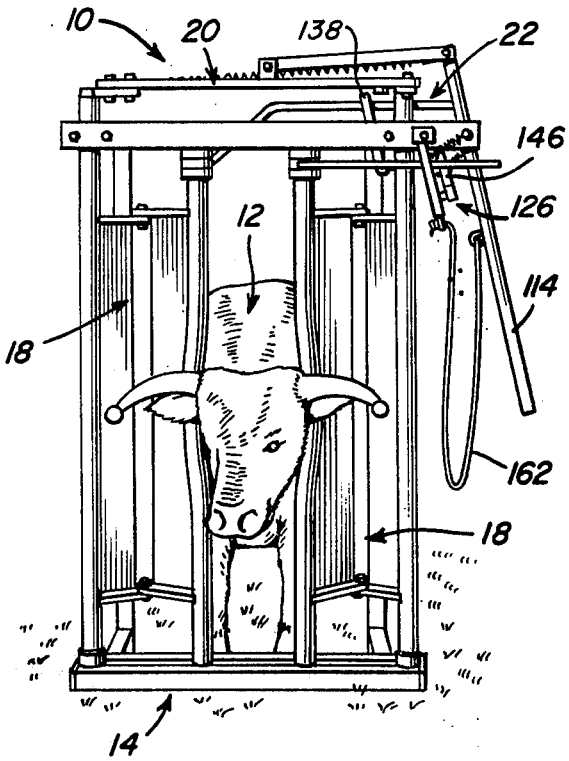
FIG. 2 is a front perspective view similar to FIG. 1, but showing a cow or steer restrained by the headgate shown in its closed position.

Referring now more particularly to FIGS. 1 and 2 of the drawings, an automatic headgate 10 for animals such as a steer or cow 12 includes a rigid, vertically standing frame 14 provided with an opening 16 forming a passage for a cow 12 or other animal. Mounted on frame 14 is a gate assembly 18 for selective movement between an open position, as shown in FIG. 1, which permits an animal to pass through opening 16 provided in frame 14 and additionally forms a traffic funnel for guiding animals into position within frame 14, and a closed position in which the gate assembly 18 forms a stanchion restraining an animal from movement, as is shown in FIG. 2. A force-applying arrangement 20 is connected to gate assembly 18 for biasing gate assembly 18 toward the closed position as shown in FIG. 2, while a trigger mechanism 22 is also connected to the gate assembly 18 for releasably retaining the gate assembly 18 in the gate, or FIG. 1, position and releasing the gate assembly 18 to its closed, or FIG. 2, position when pressure lateral of the vertical frame 14 is applied to the gate assembly 18.

Referring now more particularly to FIGS. 3 through 6 of the drawings, frame 14 is substantially rectangular in configuration and includes a sill 24 and a lintel 26, each provided with a longitudinally extending track-forming slot 28 and 30, respectively, the slots being substantially parallel to each other. Frame 14 further includes a back frame 32 attachable to an appropriate gateway, such as that associated with a chute or corral, and including a pair of spaced, substantially vertically and parallel disposed posts 34 and 36 connected to sill 24 and lintel 26 as by the illustrated projections 38, 40 and 42, 44, respectively, for supporting lintel 26 above sill 24 and for maintaining frame 14 in a substantially vertical orientation.

Gate assembly 18 includes a pair of folding panels 46 and 48 each connected to sill 24 and lintel 26, and each comprising two sections 50, 52 and 54, 56, respectively, pivotally joined together. One of the sections 50 and 54 is pivotally mounted on respective tubes 58 and 60 disposed in bearing 62 and 64 and extending through holes provided in lintel 26 so that the sections 50 and 54 extend substantially between the sill 24 and lintel 26 and are pivotally or rotatably mounted with respect thereto. The other of the sections 52 and 56 of panels 46 and 48 are provided with respective pins 66 and 68 and coaxial trunions 70 and 72. More specifically, each set of a pin 66, 68 and associated trunnions 70 and 72 are mounted at axially disposed ends of squeezing posts 74 and 76 and each provided with respective bowed portion 78 and 80 for receiving the neck of an animal to be restrained. Pins 66 and 68 slidably engage in the slot 28 provided in sill 24, while the trunnions 70, 72 slidably engage in the slot 30 provided in the lintel 26. In this manner, the sections 50, 52 and 54, 56 of the panels 46, 48 are permitted to fold upon one another when the gate assembly 18 is in the open position as shown in FIG. 1.

The pairs of sections 50, 52 and 54, 56 are articulated to one another as by pins 82, 84 and 86, 88 which pivotally connected together the respective pairs of cooperating arms 90, 92 and 94, 96 for panel 46, and arms 98, 100 and 102, 104 for panel 48. More specifically, arms 90 and 92 are connected to tube 58, while arms 94 and 96 are attached to post 74. In a like manner, arms 98 and 100 are affixed to post 80, while arms 102 and 104 are attached to tube 60.

Referring now more particularly to FIGS. 7 through 10 of the drawings, the force-applying arrangement 20 includes a pair of cranks 106 and 108, with crank 106 being affixed to the uppermost end of tube 58 above the lintel 26, and crank 108 being affixed to the tube 60 also above lintel 26. Both cranks 106 and 108 are attached to the respective tubes 58 and 60 for rotation therewith. A link 110 is pivotally connected to and extends between cranks 106 and 108 to constrain pivotal movement of tubes 50 and 60 in opposite directions. A coiled tension spring 112 is connected between crank 106 and the frame 14 by the trigger mechanism 22. More specifically, the trigger mechanism 22 includes a lever 114 pivotally mounted at one end of lintel 26 as by the illustrated ears 116 and 116'. Spring 112 is connected to crank 106 as by the connector 118 and to the lever 114 at a point above the ears 116 as by a connector 120. A coupler link 122 pivotally mounted to lever 114 adjacent the connection thereto of connector 120 attaching spring 112 to lever 114 operably connects lever 114 to the mid-portion of link 110. As can be appreciated, pivotal movement of the lever 114 will deflect spring 112 on opening of the panels 46 and 48 so as to place a predetermined bias on the panels 46 and 48 whenever the gate assembly 18 is in the open position, as shown in FIG. 1.

Trigger mechanism 22 further includes lock devices 124 and 126 for releasably holding the panels 46 and 48 in place between and including the open position and the closed position of gate assembly 18. Basically, lock device 124 holds the gate assembly 18 in the open position, while lock device 126 holds the gate assembly 18 in the closed position, although either device may function to hold the gate assembly in either position in the event one of the lock devices 124, 126 becomes inoperative for any reason.

Figure 8:
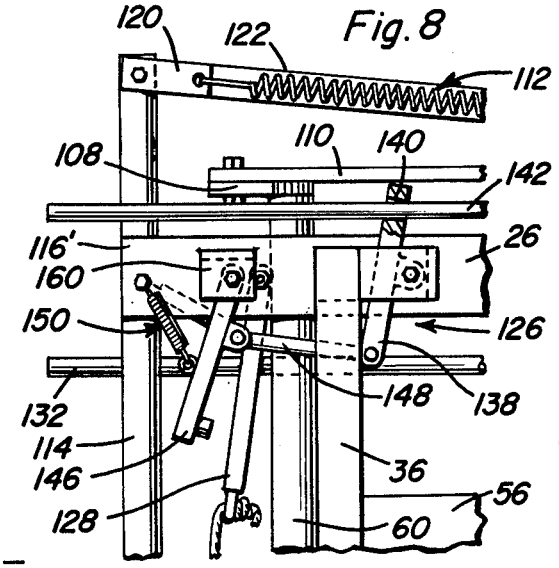
FIG. 8 is an enlarged, fragmentary, detailed view showing the upper left hand portion of FIG. 4.

Lock device 124 includes an element 128 pivotally mounted on frame 14, or more specifically on lintel 26, and provided with an aperture 130 (FIG. 9) which slidably receives a rod 132 pivotally mounted on post 76 as by a suitable collar 134 retained between a pair of flanges provided on post 76. A suitable coiled tension spring 136 is connected between element 128 and ear 116 in order to bias element 128 in the counterclockwise direction as seen from the front of headgate 10. In a similar manner to lock device 124, lock device 126 includes an element 138 pivotally mounted on lintel 26 and provided with an aperture 140 (FIG. 8) which slidably receives a rod 142 pivotally mounted on post 74 as by a collar 144. Device 126 additionally includes an arm 146 pivotally mounted on lintel 26 adjacent ear 116' and connected to element 138 as by a link 148 for releasing rod 142 when arm 146 is pivoted toward element 138. A suitable coiled tension spring 150 is connected between arm 146 and ear 116' in order to bias arm 146 in the direction causing rod 142 to be locked within aperture 140 provided in element 138. Arm 146 also includes a laterally projecting abutment 152 positioned for contacting element 128 and moving same toward a position releasing rod 132 whenever arm 146 is moved counterclockwise as seen in FIG. 8 of the drawings.

Figure 7:
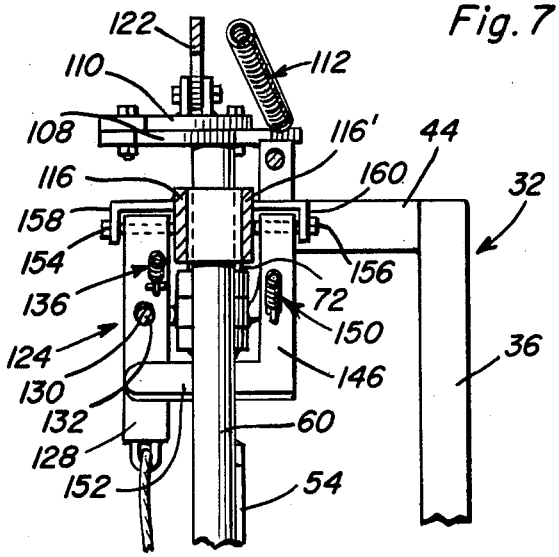
FIG. 7 is an enlarged, fragmentary, sectional view taken generally along the line 7—7 of FIG. 3.

As perhaps can best be seen in FIG. 7 of the drawings, the elements 128 and 146 are pivotally mounted on opposed sides of lintel 26 as by pins 154 and 156 disposed in generally U-shaped brackets 158 and 160 provided on the sides of lintel 26.

Figure 11:
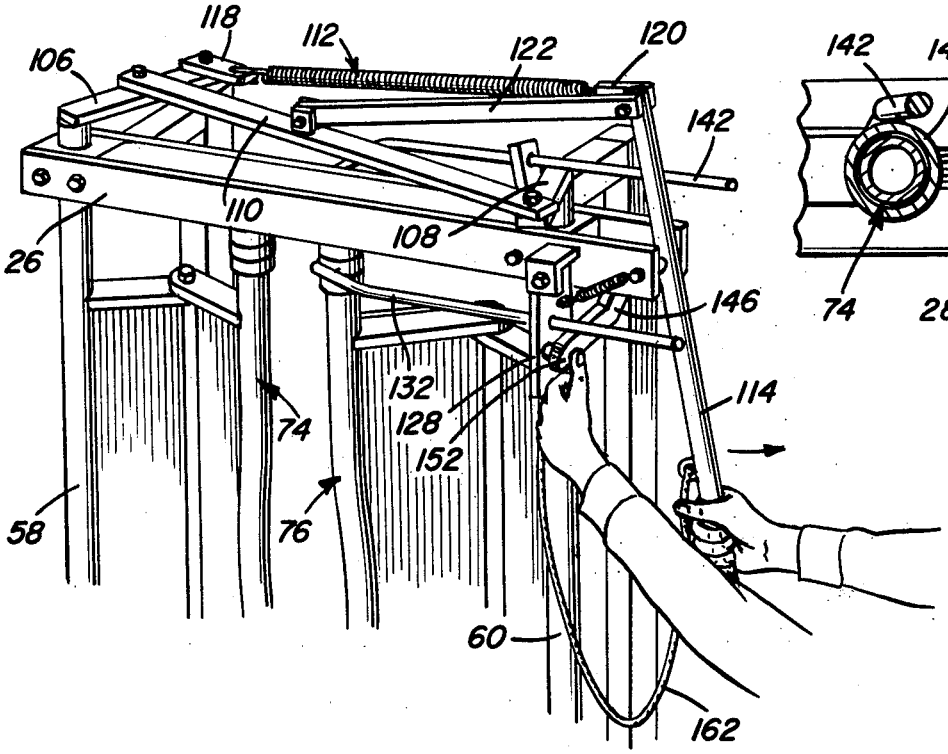
FIG. 11 is a fragmentary, perspective view showing the manner of moving the gate assembly of the invention from its closed position to its open position.
Figure 10:
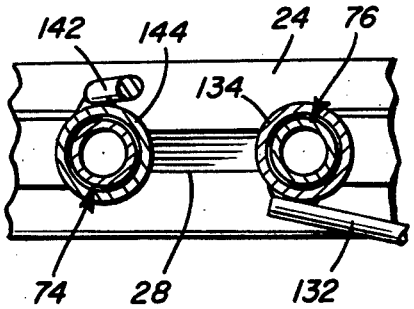
FIG. 10 is an enlarged, fragmentary, sectional view taken generally along the line 10—10 of FIG. 3.
Figure 4:
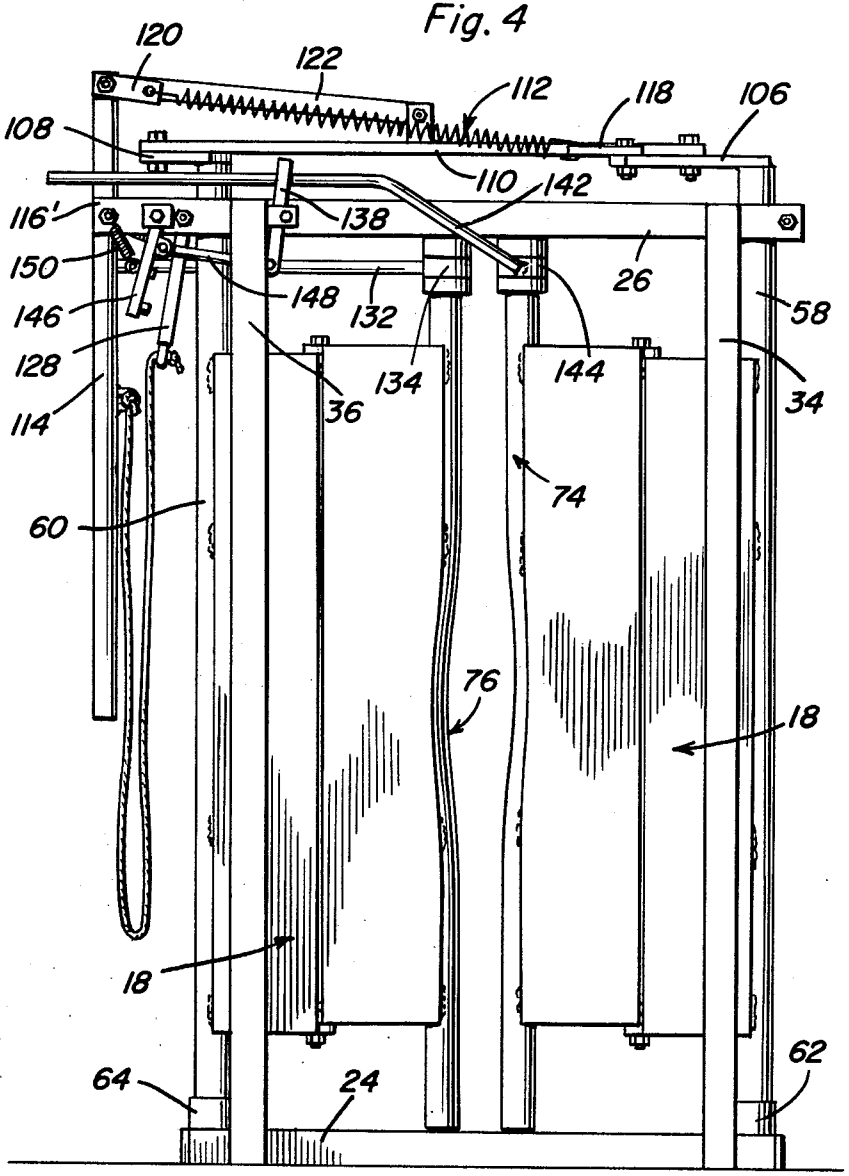
FIG. 4 is a rear elevational view showing the headgate of FIG. 3.
Figure 3:
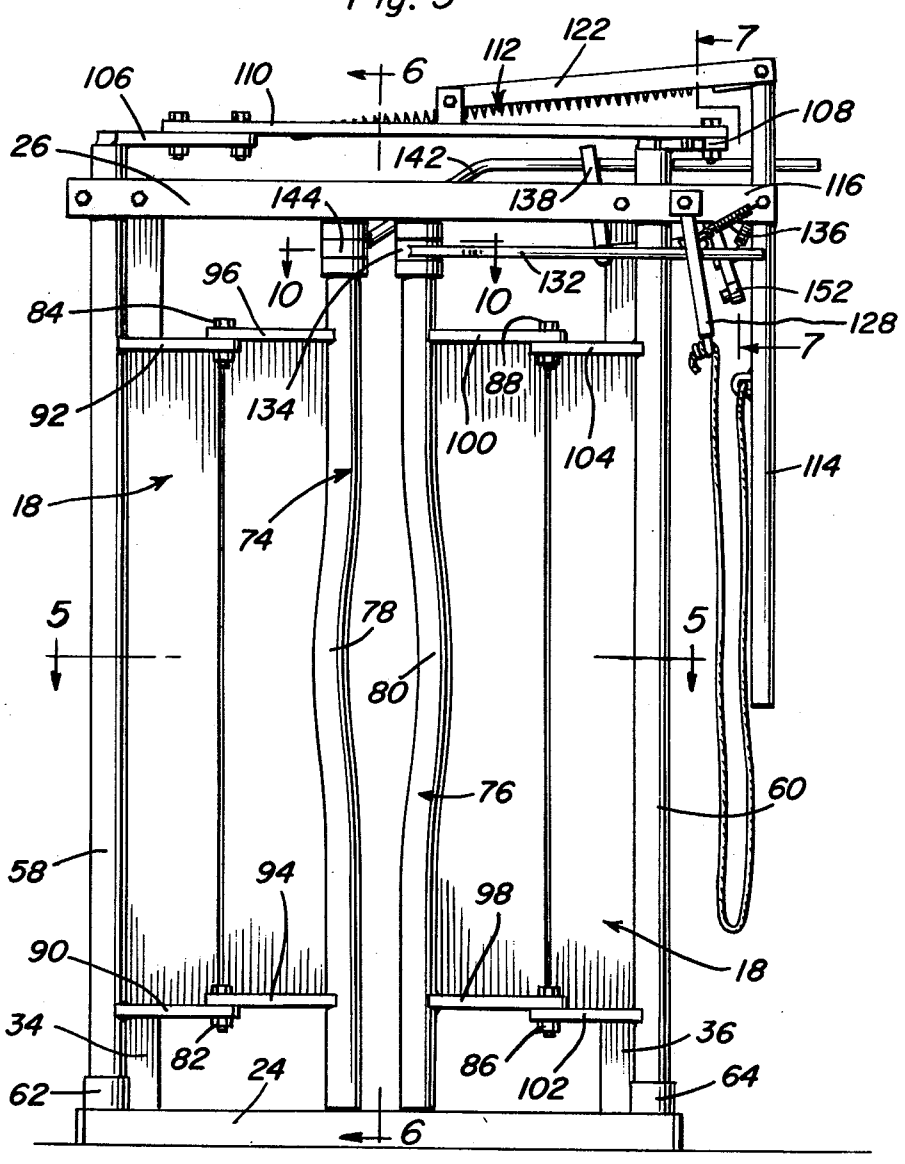
FIG. 3 is a front elevational view showing the headgate of FIGS. 1 and 2, with the gate assembly in its closed position.
Figure 5:
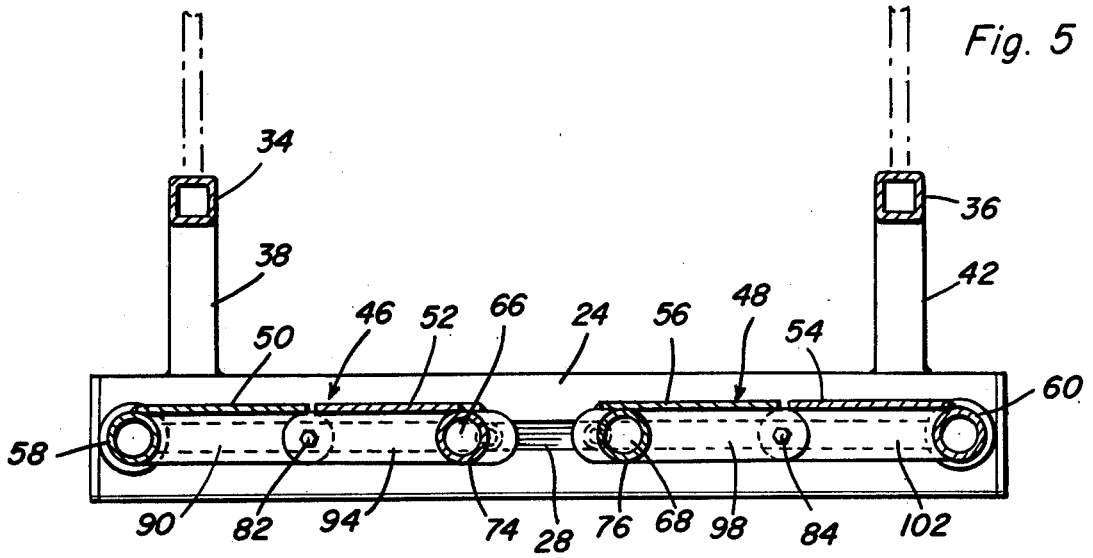
FIG. 5 is an enlarged, sectional view taken generally along the line 5—5 of FIG. 3.
Figure 6:
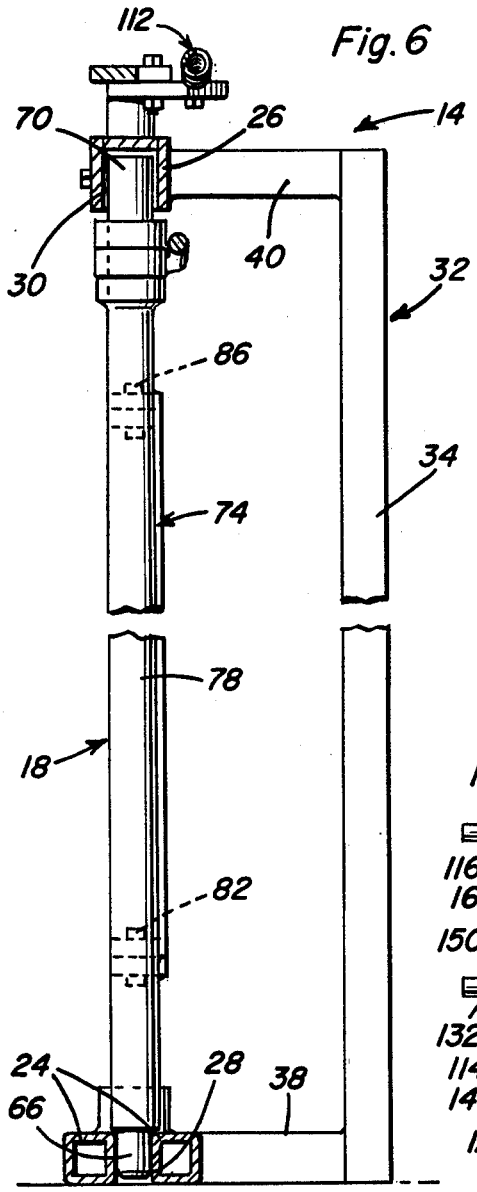
FIG. 6 is an enlarged, sectional view taken generally along the line 6—6 of FIG. 3.
Figure 9:
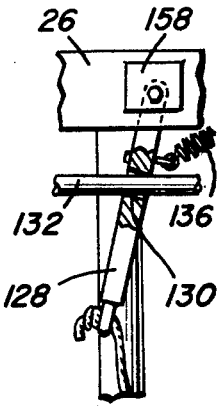
FIG. 9 is an enlarged, fragmentary, detailed view, partly cut away and in section, showing a portion of the upper right hand part of FIG. 3, with a particular element forming one of the locking devices according to the invention being shown in a moved position.

Operation of headgate 10 will now be described in conjunction with FIG. 11 of the drawings as well as FIGS. 1 and 2. When gate assembly 18 is to be opened from its closed position, abutment 152 is pushed clockwise as seen from the front of headgate 10 by an operator pushing against the abutment 152 with one hand. This movement of abutment 152, and accordingly the arm 146 permanently attached to abutment 152, will cause elements 128 and 138 to be pivoted clockwise also as seen from the front of headgate 10 as viewed in FIGS. 3 and 11. Such movement will cause the elements 128 and 138 to release the respective rods 132 and 142 and permit the operator to pivot lever 114 counterclockwise with the other hand and open the gate assembly 18 by folding the panels 46 and 48. When element 128 of lock device 124 is positioned as shown in FIG. 11, however, the rod 132 disposed in aperture 130 of element 128 will be restrained from movement in the opposite direction so as to prevent the panels 46 and 48 from unfolding and allowing gate assembly 18 to reclose. FIG. 9 shows a detail of the manner in which element 128 grips 132 when disposed as shown in FIG. 11. The trap is now as shown in FIG. 1 and is set for capturing an animal attempting to pass through headgate 10.

When an animal such as a steer or cow 12 attempts to pass through opening 16 provided in headgate 10 when gate assembly 18 is in the open position as shown in FIG. 1, the slightest amount of pressure lateral of either of the squeeze posts 74 and 76 will cause slight movement of rod 132 relative to aperture 13 of element 128 and permit the lock device 124 to release rod 132 and cause the panels 46 and 68 to unfold under the bias of the spring 112 in order to close the squeeze posts 174 and 176 against the neck of cow 12. This is the position shown in FIG. 2. Once closed against the cow or other animal, however, element 138 of lock device 126 will be in the position shown in FIG. 2 wherein the rod 142 will not be able to move the aperture 140 relative to element 138 in order to permit the panels 46 and 48 to refold under pressure exerted by the animal trapped between posts 74 and 76 and cause the gate assembly 18 to reopen so that the animal may escape.

It will be appreciated that if one of the lock devices 124 and 126 should become inoperative for any reason, manual manipulation of the remaining operable lock will permit continued operation of headgate 10, although not in a fully automatic manner. The locking latches or devices 124 and 126 are infinitely variable and quiet inasmuch as they require no notches, clicks, and the like. Further, use of a lock device constructed as is lock device 124 permits a very quick release under the bias of the arrangement including spring 112 when an appreciable amount of lateral pressure is applied to the squeeze posts 74 and 76, when the gate assembly 18 is in the open position, but due to the use of the lock device 126 the animal will be unable to reopen gate assembly 18 once trapped.

Although it is primarily contemplated that operation of headgate 10 according to the invention will normally be automatic inasmuch as the gate assembly 18 will close and capture an animal whenever the animal bumps the vertical squeezing posts 74 and 76 with his shoulders, it is also contemplated to provide for semi-automatic operation by connecting a flexible member 162, such as a length of cord, to the lower end of element 128 and to lever 114 but below the point where lever 114 is pivotally mounted between the ears 116 and 116' of lintel 26. By use of this flexible member 162, an operator can stand sufficiently far away from headgate 10 to avoid injury from horned animals, and the like, and can merely pull on the cord in order to assure proper release of the lock device 124 whenever semi-automatic operation of headgate 10 is indicated. Further, a pole (not shown) and the like may be employed to deactivate the locks 124 and 126 from a distance and the flexible member 162 employed to pull lever 114 so as to reopen the gate assembly 18 from a point safely spaced from the headgate 10.

As can be readily understood from the above description and from the drawings, an animal headgate according to the present invention provides a simple, yet rugged and reliable device for safely capturing animals of various sizes by automatic, semi-automatic and manual operation as indicated by a particular situation.

The foregoing is considered as illustrative only of the principles of the invention. Further, since numerous modifications and changes will readily occur to those skilled in the art, it is not desired to limit the invention to the exact construction and operation shown and described, and accordingly all suitable modifications and equivalents may be resorted to, falling within the scope of the invention.

What is claimed as new is as follows:

1. An automatic headgate for animals, comprising, in combination:

(a) a rigid, vertically standing frame provided with an opening permitting an animal to pass through the frame;

(b) gate means mounted on the frame for selective movement between an open position permitting an animal to pass through the opening provided in the frame and a closed position in which the gate means forms a stanchion restraining an animal from movement;

(c) force-applying spring means connected to the gate means for biasing the gate means toward the closed position; and (d) trigger means movably mounted on the frame and connected to the spring means and the gate means for displacing the gate means to the open position while deforming the spring means, said trigger means including lock means for releasably retaining the gate means in the open position and releasing the gate means to the closed position under the bias of the spring means when pressure lateral of the vertical frame is applied to the gate means from within the opening provided in the frame.

2. A structure as provided in claim 1, wherein the frame is substantially rectangular and includes a sill and a lintel, each of the sill and lintel provided with a longitudinally extending track-forming slot substantially parallel to the slot provided in the other of the sill and lintel.

3. A structure as provided in claim 2, wherein the frame further includes a back frame attachable to a gateway and including a pair of spaced, parallel, posts connected to the sill and lintel for supporting the lintel above the sill.

4. A structure as defined in claim 2, wherein the gate means includes a pair of folding panels each connected to the sill and lintel and comprising two sections pivotally jointed together, one of the sections arranged pivotally mounted on and extending between the sill and lintel, and the other of the sections provided with a pin and a trunnion coaxially and oppositely directed from one another, the pin slidably engaging in the slot provided in the sill and the trunnion slidably engaging in the slot provided in the lintel.

5. A structure as defined in claim 4, wherein the section of each of the panels which is provided with the pin and trunnion includes a squeeze post having a bowed portion for receiving the neck of an animal and arranged extending between the sill and the lintel, the pin and trunnion being mounted on the squeeze posts.

6. A structure as defined in claim 4, wherein the force-applying means includes a pair of cranks, one of the cranks being affixed to a one of the panels and disposed above the lintel, and the other of the cranks being affixed to the other of the panels also above the lintel, a link pivotally connected to and extending between the cranks, and a coiled tension spring connected to one of the cranks and to the frame for exerting a bias on both of the cranks through the link.

7. The combination of claim 1, wherein said gate means includes a pair of panel assemblies pivotally mounted on the frame and linkage means interconnecting the panel assemblies for simultaneous movement between the open and closed positions, said spring means being connected between the linkage means and the frame through the trigger means.

8. The combination of claim 7 wherein said panel assemblies are formed by articulated folding panels establishing a traffic funnel in the open position of the gate means.

9. An automatic headgate for animals, comprising, in combination:

(a) a rigid, vertically standing frame provided with an opening permitting an animal to pass through the frame;

(b) gate means mounted on the frame for selective movement between an open position permitting an animal to pass through the opening provided in the frame and forming a traffic funnel for guiding the animal into a desired position for capture, and a closed position in which the gate means forms a stanchion restraining an animal from movement;

(c) force-applying means connected to the gate means for biasing the gate means toward the closed position; and (d) trigger means connected to the gate means for releasably retaining the gate means in the open position and releasing the gate means to the closed position when pressure lateral of the vertical frame is applied to the gate means from within the opening provided in the frame, the frame being substantially rectangular and including a sill and a lintel, each of the sill and lintel provided with a longitudinally extending track-forming slot substantially parallel to the slot provided in the other of the sill and lintel, the gate means including a pair of folding panels each connected to the sill and lintel and comprising two sections pivotally jointed together, one of the sections arranged pivotally mounted on and extending between the sill and lintel, and the other of the sections provided with a pin and a trunnion coaxially and oppositely directed from one another, the pin slidably engaging in the slot provided in the sill and the trunnion slidably engaging in the slot provided in the lintel, the force-applying means including a pair of cranks, one of the cranks being affixed to a one of the panels and disposed above the lintel, and the other of the cranks being affixed to the other of the panels also above the lintel, a link pivotally connected to and extending between the cranks, and a coiled tension spring connected to one of the cranks and to the frame for exerting a bias on both of the cranks through the link, the trigger means including a lever pivotally mounted on the lintel and connected to the link, with the coiled tension spring being connected to the frame by means of attachment to the lever, pivotal movement of the lever deflecting the spring and placing a bias on the panels when same are in the open position of the gate means.

10. A structure as defined in claim 9, wherein the trigger means further includes lock means for releasably holding the panels in place continuously between the open position and the closed position of the gate means.

11. A structure as defined in claim 10, wherein the lock means includes a first element pivotally mounted on the frame and provided with a first aperture, and a first rod pivotally mounted on one of the panels and disposed slidably extending through the first aperture.

12. A structure as defined in claim 11, wherein the lock means further includes a second element pivotally mounted on the frame and provided with a second aperture and a second rod pivotally mounted on the other of the panels and slidably disposed in the second aperture.

13. A structure as defined in claim 12, wherein the locking means still further includes an arm pivotally mounted on the frame and a further link connected to the arm and to the second element for releasing the second rod when the arm is pivoted toward the second element, an abutment provided on the arm of engaging the first element when the arm is pivoted toward the second element in order to permit the first element to permit the panels to move from the closed position of the gate means to the open position of same.

14. A structure as defined in claim 13, wherein a flexible member is connected to the first element and to the lever, the flexible member being arranged for permitting manual release of the panels.

15. An automatic headgate for animals, comprising a rigid frame, gate means operatively mounted on the frame for movement between an open position and a closed position, force-applying means rendered operative in response to deformation thereof for biasing the gate means to the closed position, selectively operated means connected to the gate means and the force-applying means for simultaneously displaying the gate means to the open position and deforming the force-applying means to render the same operative, and lock means for holding the gate means against movement to the closed position under the bias of the force-applying means and releasable in response to opening pressure applied to the gate means in the open position thereof.

16. The combination of claim 15, wherein said force-applying means includes a tension spring connected to the selectively operated means.

* * * * *